US012245670B2

(12) United States Patent
Guo

(10) Patent No.: US 12,245,670 B2
(45) Date of Patent: Mar. 11, 2025

(54) CONVENIENT EJECTION-TYPE CARD BOX

(71) Applicant: Guangzhou Baiyunqu Zhuofan Leather Factory, Guangzhou (CN)

(72) Inventor: Suixiang Guo, Ganzhou (CN)

(73) Assignee: Guangzhou Baiyunqu Zhuofan Leather Factory, Guangzhou (CN)

( * ) Notice: Subject to any disclaimer, the term of this patent is extended or adjusted under 35 U.S.C. 154(b) by 0 days.

(21) Appl. No.: 18/732,664

(22) Filed: Jun. 4, 2024

(65) Prior Publication Data

US 2024/0407515 A1 Dec. 12, 2024

(30) Foreign Application Priority Data

Jun. 12, 2023 (CN) ..... 202321488235.0

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS

| | | | | |
|---|---|---|---|---|
| 4,792,058 | A * | 12/1988 | Parker | B65D 83/12 221/232 |
| 11,439,214 | B2 * | 9/2022 | Tran | B25F 1/04 |
| 2018/0310681 | A1 * | 11/2018 | Wingerter | B42F 17/32 |
| 2019/0269213 | A1 * | 9/2019 | Deng | A45F 5/02 |
| 2019/0387853 | A1 * | 12/2019 | Chan | A45C 11/18 |
| 2020/0305564 | A1 * | 10/2020 | Myers | A45C 1/06 |
| 2021/0219685 | A1 * | 7/2021 | Van Geer | B65D 83/08 |
| 2022/0061485 | A1 * | 3/2022 | Rodriguez | G09F 3/207 |

FOREIGN PATENT DOCUMENTS

| | | | |
|---|---|---|---|
| CN | 110464096 | A * | 11/2019 |
| CN | 111976333 | A * | 11/2020 |

* cited by examiner

*Primary Examiner* — Don M Anderson
*Assistant Examiner* — Justin Caudill
(74) *Attorney, Agent, or Firm* — Jose Cherson Weissbrot

(57) ABSTRACT

A novel convenient ejection-type card box comprises a card box body, wherein a push component is arranged inside the card box body, and the push component comprises a pressing member, one end of which is connected with the pushing member, and one side of the pushing member is connected with a connecting post; one end of the pressing member is provided with a movable groove adapted to the connecting post, and a torsion spring is connected between the pressing member and the card box body. A pressing member with a movable groove, a pushing member with a connecting post and a torsion spring are arranged in the card box body for cooperative use, and the pressing member is pressed inward into the card box body to eject the card from the card box body, so that the ejected cards are arranged in a stepped manner.

6 Claims, 4 Drawing Sheets

CONVENIENT EJECTION-TYPE CARD BOX

CROSS-REFERENCE TO RELATED APPLICATIONS

The application claims priority of Chinese Patent No. 202321488235.0, filed on Jun. 12, 2023, the contents of which are incorporated herein by reference.

TECHNICAL FIELD

The present application relates to the field of office and daily necessities, in particular to a novel convenient ejection-type card box.

BACKGROUND

Office and daily necessities refer to the auxiliary articles used by people in their daily work and life.

At present, there are many kinds of office supplies, among which personal or corporate cards are made for enterprises, which is convenient for people to check and use. However, now cards are stored in card boxes, which is convenient for cards to carry around. However, at present, it is difficult to take one card at a time from the card box used for cards, and it is likely to take out multiple cards at the same time.

Therefore, it is necessary to provide a convenient and novel card box to solve the above technical problems.

SUMMARY

The present application provides a novel convenient ejection-type card box, which solves the problem that it is difficult to take cards one by one from the existing card box, and it is likely to take out multiple cards at the same time.

In order to solve the above technical problem, the present application provides a novel and convenient ejection-type card box, which includes:

a card box body, wherein a pushing component is arranged in the card box body, and the pushing component comprises a pressing member; one end of the pressing member is connected with a pushing member; one side of the pushing member is connected with a connecting post; one end of the pressing member is provided with a movable groove adapted to the connecting post; and a torsion spring is connected between the pressing member and the card box body.

Preferably, both sides of an inner wall of the card box body are connected with elastic sheets.

Preferably, one side of a surface of the card box body is provided with a communication hole.

Preferably, an elastic clip is connected to a center of a back face of the card box body.

Preferably, a protective component is arranged a the surface of the card box body on a side opposite to the pressing member, and the protective component comprises a connecting plate, a surface of the connecting plate is provided with a chute, and a slider is slidably connected inside the chute.

Preferably, one side of the slider is connected with an L-shaped protective plate.

Preferably, a spring is arranged inside the chute on a side opposite to the slider.

Compared with the related art, the present application provides a convenient novel card box with the following beneficial effects:

The present application provides a novel convenient ejection-type card box, wherein a pressing member with a movable groove, a pushing member with a connecting post and a torsion spring are arranged in the card box body for cooperative use, and the pressing member is pressed inward into the card box body to eject the card from the card box body to the outside of the card box body, so that the ejected cards are arranged in a stepped manner, which is convenient for users to identify and take the card, and at the same time, the pressing member can quickly be returned to the original point under the action of the torsion spring.

Reference signs in the figures: 1. Card box body, 2. Pushing component, 21, Pressing members, 22, Pushing member, 23, Connecting post, 24, Movable groove, 25, Torsion spring, 3, Elastic sheet, 4, Communication hole, 5, Elastic clip, 6. Protective component, 61. Connecting plate, 62. Chute, 63. Slider, 64. L-shaped protective plate, 65. Spring.

DESCRIPTION OF EMBODIMENTS

The present application will be further explained with reference to the drawings and implementation modes.

Embodiment 1

Figure 1:
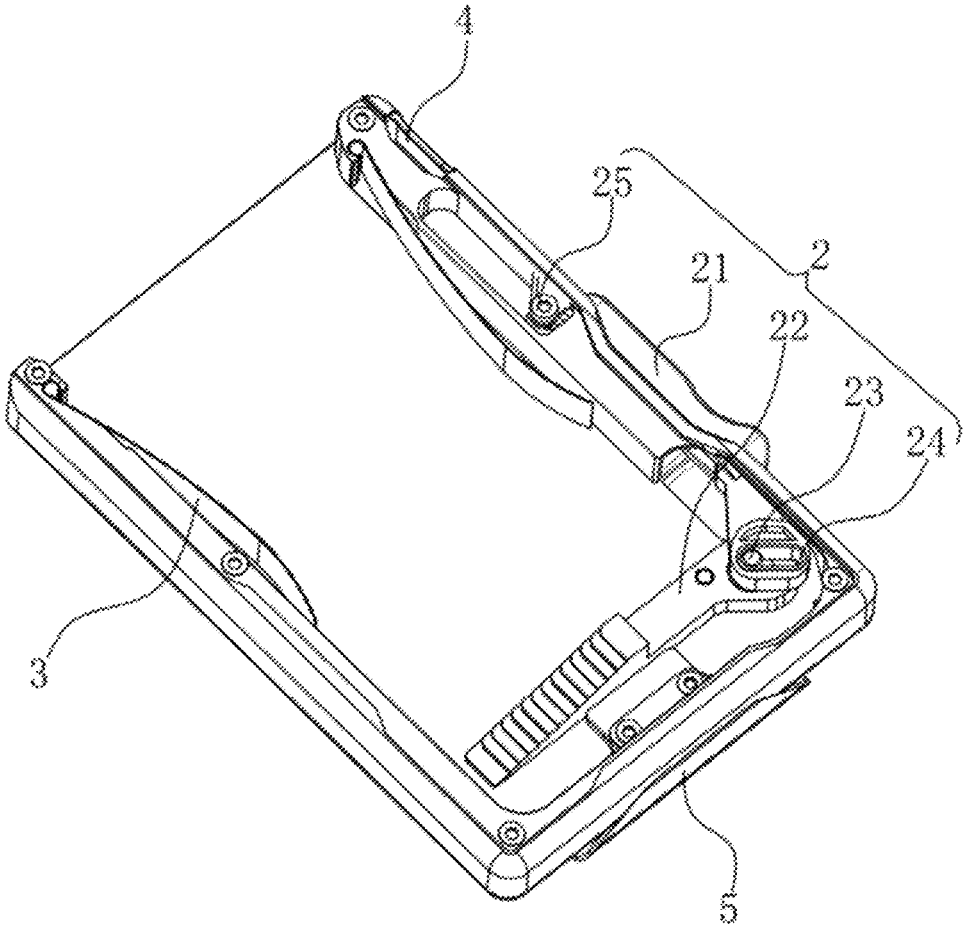
FIG. 1 is a structural schematic diagram of Embodiment 1 of a novel convenient ejection-type card box provided by the present application.
Figure 2:
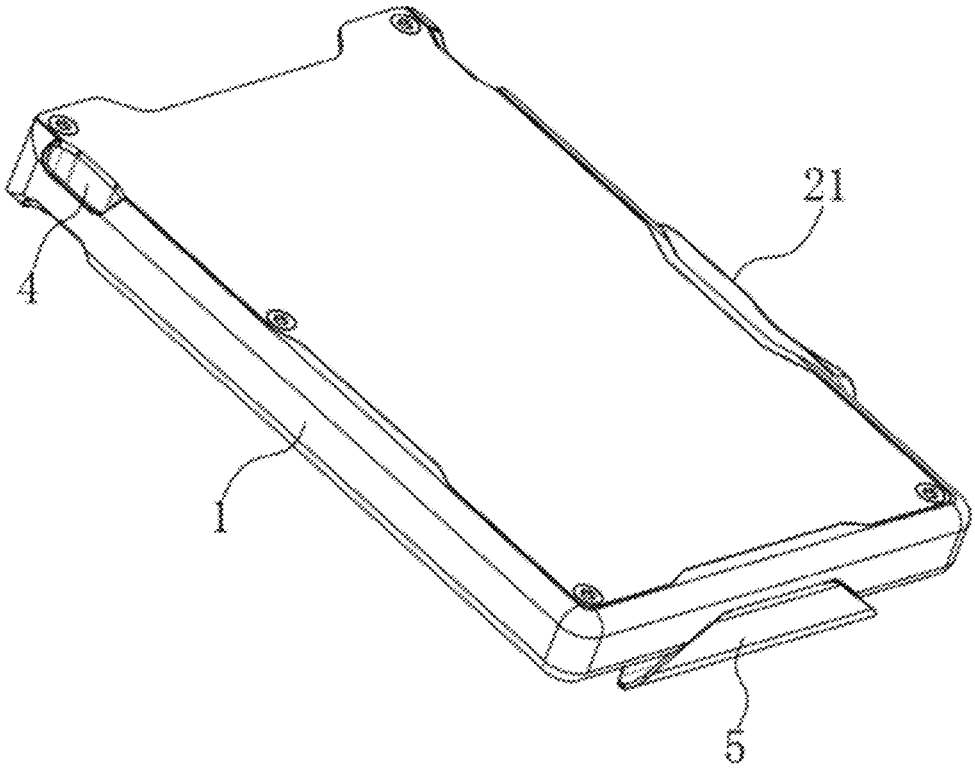
FIG. 2 is a schematic view of the overall three-dimensional structure of the device shown in FIG. 1.
Figure 3:
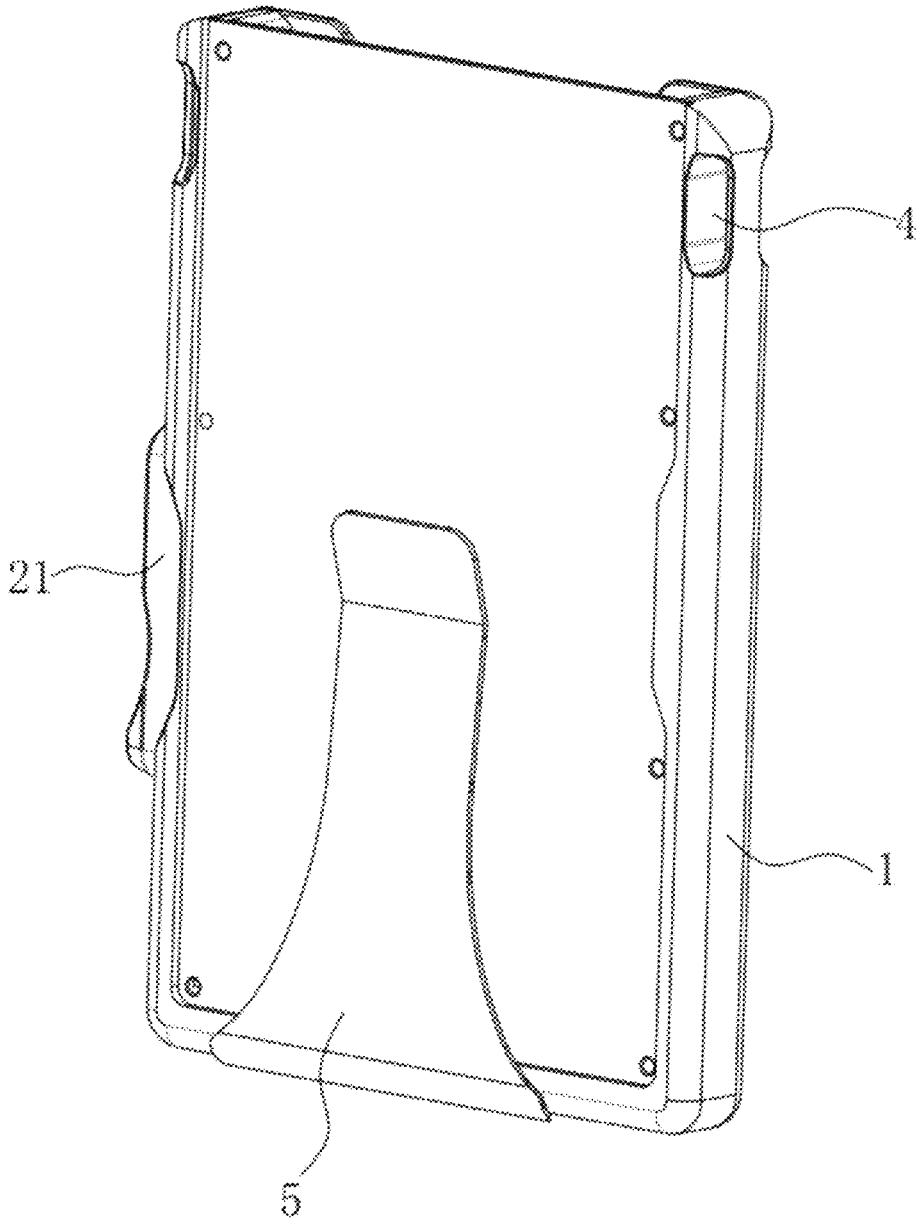
FIG. 3 is a schematic view of the overall back structure of the device shown in FIG. 1.

Please refer to FIG. 1, FIG. 2 and FIG. 3 together, wherein, FIG. 1 is a structural schematic diagram of Embodiment 1 of a novel convenient ejection-type card box provided by the present application; FIG. 2 is a schematic view of the overall three-dimensional structure of the device shown in FIG. 1; FIG. 3 is a schematic view of the overall back structure of the device shown in FIG. 1. A novel convenient ejection-type card box includes:

a card box body 1, wherein a pushing component 2 is arranged in the card box body 1, and the pushing component 2 includes a pressing member 21; one end of the pressing member 21 is connected with a pushing member 22; one side of the pushing member 22 is connected with a connecting post 23; one end of the pressing member 21 is provided with a movable groove 24 adapted to the connecting post 23; and a torsion spring 25 is connected between the pressing member 21 and the card box body 1.

The side of the card box body 1 is provided with a movable communication groove adapted to the pressing member 21, one side of the pressing member 21 is rotatably connected with the card box body 1 through a rotating shaft, and the connecting post 23 is rotatably connected with one side of the inner wall of the card box body 1 through a rotating shaft. The use of the connecting post 23 and the movable groove 24 facilitates the pressing member 21 to push the pushing member 22 to move up and down, and uneven clamping grooves are formed on the surface of the pushing member 22, so that when the cards are pushed to the outside of the card box body 1, the cards are staggered and thus can be easily recognized and taken by users. The torsion spring 25 can be restored to its original position after the pressing member 21 is released. The arrangement of the elastic sheet 3 can play a fixing role when the cards are placed inside the card box body 1, preventing the cards from falling inside the card box body 1. The card box body 1 is composed of two parts through screws.

Both sides of the inner wall of the card box body 1 are connected with elastic sheets 3.

One side of the surface of the card box body 1 is provided with a communication hole 4.

The center of the back of the card box body 1 is connected with an elastic clip 5.

The elastic clip 5 can fix the card box body 1 to the object, and the communication groove 4 can facilitate the connection of the card box body 1 to the object.

The working principle of a novel convenient elastic card box provided by the present application is as follows:

When in use, when the card in the card box body 1 is taken out, the pressing member 21 is pressed to move to the outside of the card box body 1; when the pressing member 21 moves, the connecting post 23 is pushed to move by the movable groove 24 at one end, and when the connecting post 23 moves, the pushing member 22 is driven to move upward, and when the pushing member 22 moves upward, the card in the card box body 1 is pushed to move upward to the outside of the card box body 1.

Compared with the related art, the present application provides a convenient novel card box with the following beneficial effects:

The present application provides a novel convenient ejection-type card box, wherein a pressing member 21 with a movable groove 24, a pushing member 22 with a connecting post 23 and a torsion spring 25 are arranged inside the card box body 1, and they are used in coordination to allow the cards inside the card box body 1 to be arranged in a staggered manner when taken out and be pushed out of the card box body 1, which is convenient for users to identify and take.

Embodiment 2

Figure 4:
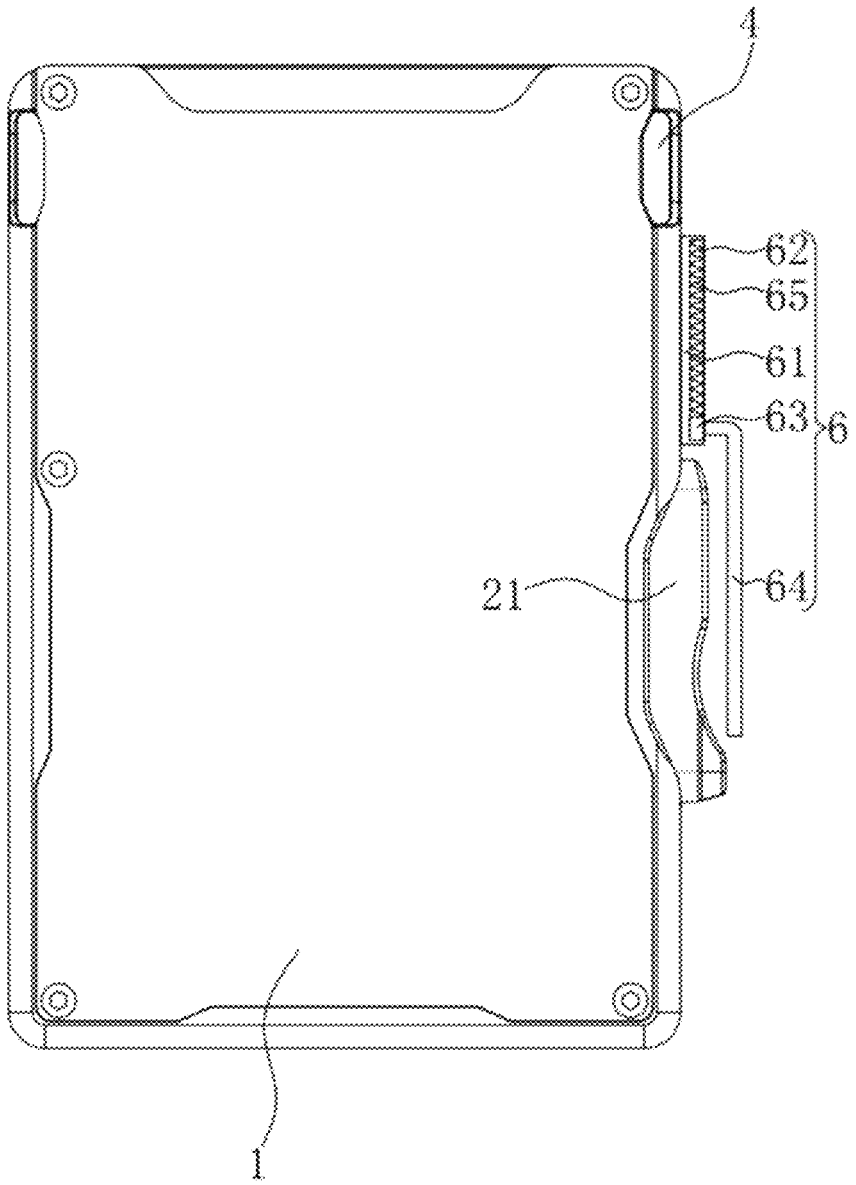
FIG. 4 is a schematic structural diagram of Embodiment 2 of a novel convenient ejection-type card box provided by the present application.

Please refer to FIG. 4. Based on a novel convenient ejection-type card box provided by Embodiment 1 of the application, Embodiment 2 of the application proposes another novel convenient ejection-type card box. Embodiment 2 is only a preferred mode of Embodiment 1, and the implementation of Embodiment 2 will not affect the independent implementation of Embodiment 1.

Specifically, the difference of a novel convenient ejection-type card box provided by Embodiment 2 of this application lies in that a protective component 6 is arranged on the surface of the card box body 1 at the side opposite to the pressing member 21, and the protective component 6 includes a connecting plate 61, and a chute 62 is formed on the surface of the connecting plate 61, and a slider 63 is slidably connected inside the chute 62.

The connecting plate 61 is connected to the side of the card box body 1 and located above the pressing member 21. The use of the chute 62 and the slider 63 can play a positioning role when the L-shaped protective plate 64 moves up and down, and the spring 65 can be restored to the original position when the L-shaped protective plate 64 is not used.

One side of the slider 63 is connected with an L-shaped protective plate 64.

A spring 65 is arranged inside the chute 62 and on the opposite side of the slider 63.

The working principle of the novel convenient ejection-type card box provided by the present application is as follows:

When in use, when it is necessary to press the pressing member 21 to take out the card from the card box body 1, the L-shaped protective plate 64 is pushed upward; when the L-shaped protective plate 64 moves upward, the slider 63 is driven to move upward in the chute 62 provided on the surface of the connecting plate 61, and the spring 65 inside is pressed when the slider 63 moves in the chute 62; when the L-shaped protective plate 64 moves away from the pressing member 21, the pressing member 21 can be pressed.

Compared with the related art, the novel convenient ejection-type card box provided by the present application has the following beneficial effects:

The present application provides a novel convenient ejection-type card box, wherein a connecting plate 61 with a chute 62 is arranged on the side of the card box body 1 to cooperate with a slider 63 and an L-shaped protective plate 64, which can prevent the pressing member 21 on the side of the card box body 1 from being pressed by mistake when the card box body 1 is carried.

The above is only the embodiment of this application, and it does not limit the patent scope of this application. Any equivalent structure or equivalent process transformation made by using the description and attached drawings of this application, or directly or indirectly used in other related technical fields, are equally included in the patent protection scope of this application.

What is claimed is:

1. A novel convenient ejection-type card box, comprising:

a card box body, wherein a pushing component is arranged in the card box body, and the pushing component comprises a pressing member; one end of the pressing member is connected with a pushing member; one side of the pushing member is connected with a connecting post; one end of the pressing member is provided with a movable groove adapted to the connecting post; and a torsion spring is connected between the pressing member and the card box body; and a protective component is arranged at a surface of the card box body on a side opposite to the pressing member, and the protective component comprises a connecting plate, a surface of the connecting plate is provided with a chute, and a slider is slidably connected inside the chute.

2. The novel convenient ejection-type card box according to claim 1, wherein both sides of an inner wall of the card box body are connected with elastic sheets.

3. The novel convenient ejection-type card box according to claim 1, wherein one side of a surface of the card box body is provided with a communication hole.

4. The novel convenient ejection-type card box according to claim 1, wherein an elastic clip is connected to a center of a back face of the card box body.

5. The novel convenient ejection-type card box according to claim 1, wherein one side of the slider is connected with an L-shaped protective plate.

6. The novel convenient ejection-type card box according to claim 1, wherein a spring is arranged inside the chute on a side opposite to the slider.

* * * * *